US005308082A

United States Patent [19]

Bigelow

[11] Patent Number: 5,308,082

[45] Date of Patent: May 3, 1994

[54] SOCCER NET STORAGE COMPARTMENT

[76] Inventor: Robert Bigelow, 2511 Poppy St., East Meadow, N.Y. 11554

[21] Appl. No.: 115,575

[22] Filed: Sep. 3, 1993

[51] Int. Cl.[5] ..... A63B 63/04

[52] U.S. Cl. ..... 273/400

[58] Field of Search ..... 273/400, 411, 402

[56] References Cited

U.S. PATENT DOCUMENTS 5,186,469 2/1993 Terris ..... 273/400

5,244,213 9/1993 Armell ..... 273/400

5,273,292 12/1993 Pardi et al. ..... 273/400

*Primary Examiner*—William H. Grieb

[57] ABSTRACT

A soccer net that is stored in a folded condition under lock and key in a compartment at its game location on the playing field and thus effectively secured against weather deterioration and vandalism, and when unlocked the disassembly of the components of the compartment from about the soccer net are in paths of movement which stretch and position the net into its goal tending playing condition.

3 Claims, 3 Drawing Sheets

SOCCER NET STORAGE COMPARTMENT

The present invention relates generally to improvements for handling a soccer net, and more particularly to facilitated after-game storage and pre-game setup of the net.

EXAMPLE OF THE PRIOR ART

It is already well known as illustrated and described in U.S. Pat. No. 5,186,469 issued to George Terris on Feb. 16, 1993 to improve the handling of a soccer net by the use of a folding support frame to provide an open erect game-use net condition and, when the frame is folded closed, a compact storage condition of the net. It is still necessary, however, after a game to remove the net and frame to a location secured against vandalism and the like, and prior to a game to transport the net and frame to its playing field location.

Broadly, it is an object of the present invention to provide for the handling of a soccer net, improvements overcoming the foregoing and other shortcomings of the prior art. More particularly, it is an object to use to advantage the support of the goal post to safely store and readily place the net in goal-tending condition.

The description of the invention which follows, together with the accompanying drawings, should not be construed as limiting the invention to the example shown and described, because those skilled in the art to which this invention appertains will be able to devise other forms thereof within the ambit of the appended claims.

It should be readily appreciated that a goal-attached soccer net left unattended is vulnerable to weather damage and vandalism. However, to obviate this by removing the soccer net between games and restoring its game position at game time is time consuming and tedious. It is thus significant that, in accordance with the present invention, the soccer net is provided with safe, out-of-sight storage at the goal site, and sets up in a facilitated manner to function as intended at game time.

Figure 1:
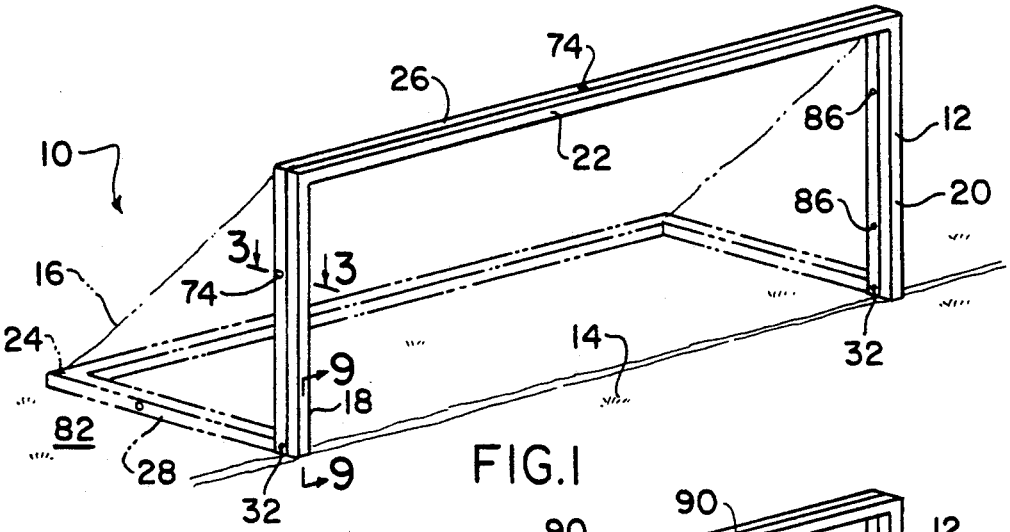
FIG. 1 is a perspective view of a soccer goal preparatory to a soccer game and depicts at this time in full line the storage of the soccer net, and in phantom line perspective depicts what is typically the game position of the soccer net.
Figure 5:
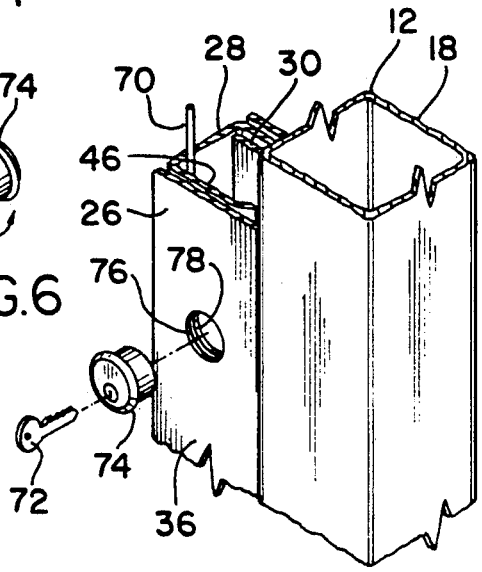

It will subsequently be explained in detail, but preliminarily assume the arriving game participants find goal 12 at its field site 14 with the soccer net in storage and initially out-of-sight as depicted in FIG. 1. Designated individuals will follow a net setup procedure, commenced by using keys 72 (FIG. 5) to unlock and remove plug type locks 74, at least one of which lock 74 is used to project through aligned openings 76 and 78 respectively in panel 36 of housing component 26 and panel 46 of housing component 28. Thusly unlocked, housing 28 conveniently engaged at a finger grip opening 50 (FIG. 7) is urged through a pivotal traverse in the direction of arrow 80 of FIG. 2 carrying with it housinq 30, the peripheral edge of soccer net 16 being secured between the housings 30 and 28 along the U-shaped peripheral edges of these housings.

Figure 2:
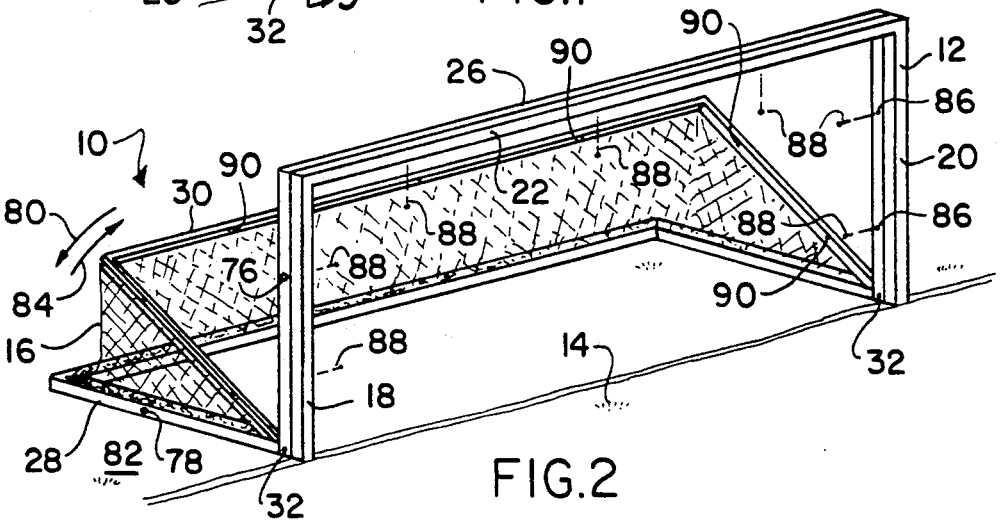
FIG. 2 is the same perspective view as FIG. 1, but illustrating how the soccer net is urged through movements between its storage and game positions.

Laid to rest on the ground 82, as shown in FIG. 2, housing 28 is left in this position and, after preparation subsequently to be noted, housing 30 is raised in the direction of arrow 84 into engagement with goal 12 established by pins 88, thereby opening soccer net 16 for game goal-tending service.

After the game, the procedure is reversed to provide for safe storage under lock and key of the soccer net 16. Pins 88 are removed and housing 30 lowered in the direction of arrow 80, as shown in FIG. 2, into the ground level housing 28, and this results in an adjacent position of the peripheral net edges 90 and, thus, the bunching of the net within the two housings 28, 30. Flaps 56 are then closed over the net 16 (not shown in FIG. 8) and held in place by VELCRO patches 60, 62.

Figure 6:
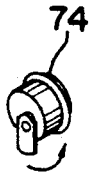
FIG. 6 is an isolated view of lock 74 as seen from the reverse side at which it is depicted in FIG. 5.

The soccer net 16 in its storage position within the compartment bounded between the housings 26, 28 is then raised in the arrow direction 84 to a position within the confines of side panels 36 and 38 of a stationary housing 26 extending rearwardly of the left, right and crosspiece posts 18, 20 and 22, respectively, of the soccer goal 12. The key-operated lock 74 is then replaced through the aligned housing openings 76 and 78 and the locking lug thereof turned as noted in FIG. 6 to complete the safe storage system 10 of the soccer net 16 at the site 14 of the soccer goal 12.

While the within inventive improvements for storing and using the soccer net 16 should be readily understood from the preceding description, for completeness, sake, structural details only alluded to will now be described in detail. Goal 12, as generally understood, is of tubing of metal construction material permanently anchored centrally at each opposite end line of the playing field for field hockey, lacrosse and, specifically in this instance, soccer. Prior art practice contemplated staking or pegging the net bottom edge 24 to the turf 82 behind the goal 12, a practice obviated by the within net storage and setup system 10.

Figure 3:
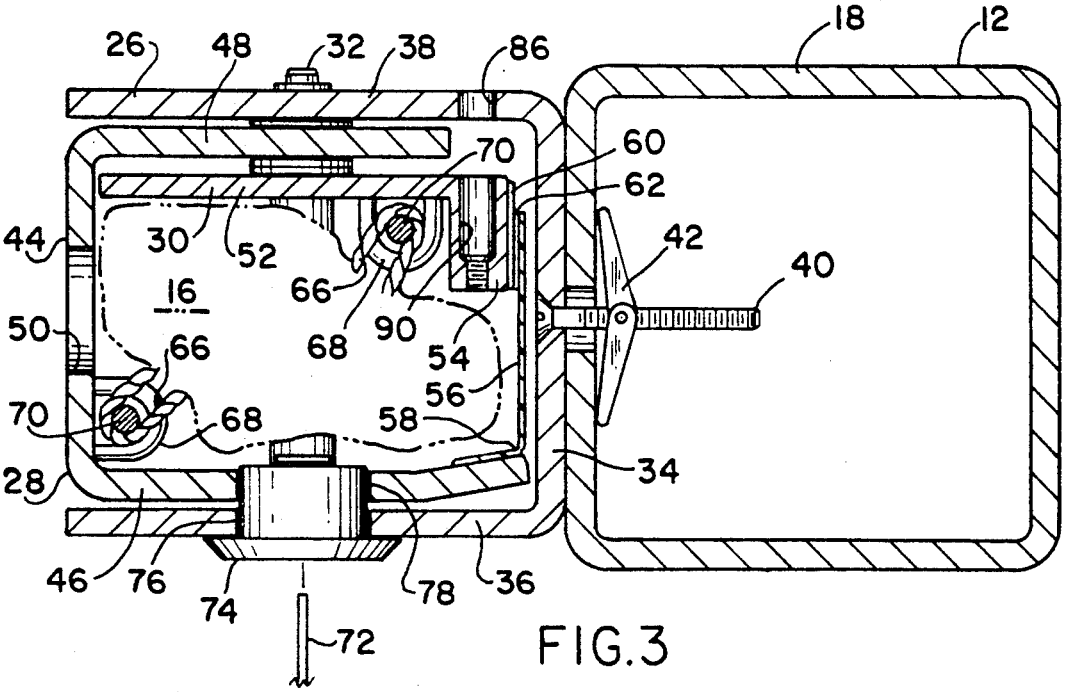
FIG. 3 is an enlarged scale sectional view taken along line 3—3 of FIG. 1 illustrating cooperating positions of components providing the storage position of the soccer net.
Figure 7:
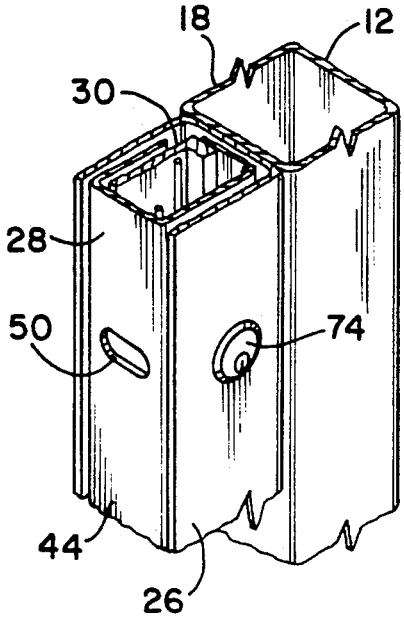
FIGS. 5 and 7 are partial perspective views of components as seen from slightly different angles, focusing on the lock 74 provided for security.

The system 10 is comprised of the use of three principal members, namely a fixed housing 26, a net-holding grounded housing 28 and a net-positioning housing 30. The pivotal traverses of housings 28 and 30 are about a pivot 32 in the bottom of the fixed or stationary housing 26, which housing, as best seen in FIG. 3, is U-shaped in cross section formed by side panels 36 and 38 and a connecting panel 34, the latter secured to goal 12 by bolts 40 and butterfly nuts 42. Similarly, housing 28 is U-shaped with side panels 46 and 48 and a connecting panel 44 provided for convenient gripping with finger holes 50 (FIG. 7). Housing 28 is sized to fit within housing 26.

Figure 8:
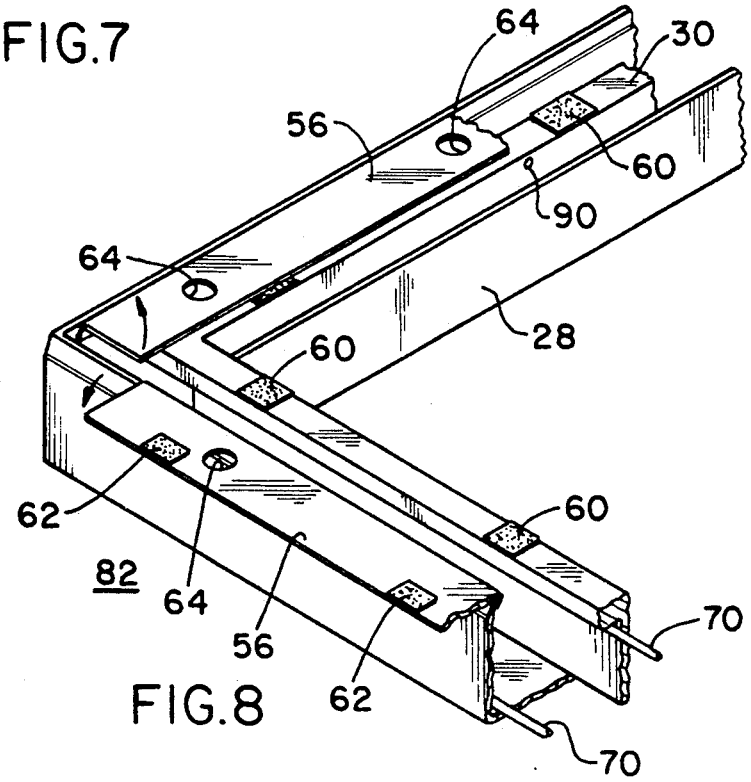
FIG. 8 is a partial perspective view of the soccer net storage components.

The housing movement which positions the net 16 is the pivotally mounted L-shaped housing 30 formed of a flat panel or wall 52 and an inturned flange 54. Flaps 56 on the panel 46 of housing 28 are provided with Velcro patches 62 cooperating with Velcro patches 60 on the flange 54, these flaps also being provided for convenient gripping with finger holes 64 (FIG. 8).

Figure 4:
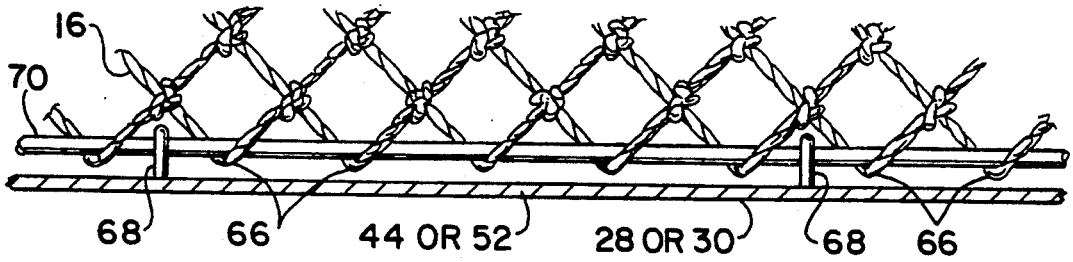
FIG. 4 is an isolated partial view illustrating how the soccer net's peripheral edge attachment to components is achieved.

To attach the net to the components, loops 66 along the edge of the net are connected to the housings 28 and 30 utilizing a series of eyelets 68 that cooperate with housing-attached rods 70, as best shown in FIG. 4.

Figure 9:
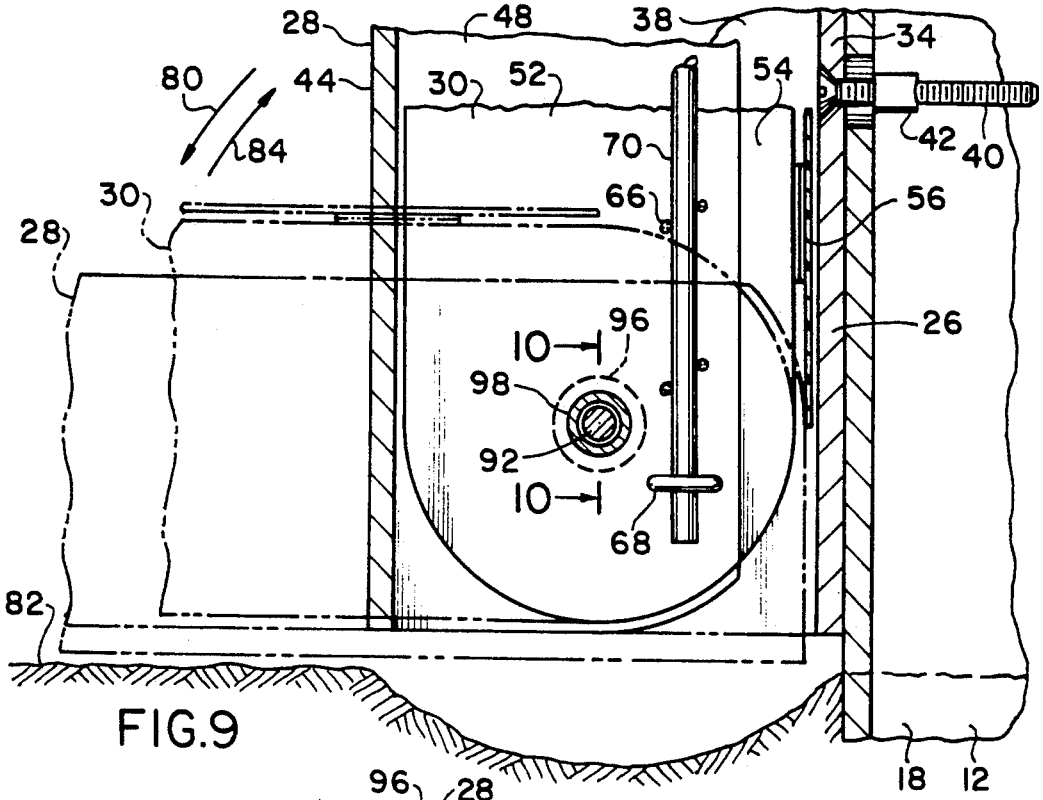
FIG. 9 is a partial cross sectional view taken along line 9—9 of FIG. 1 supplementing the structural details illustrated in FIG. 3, and focusing on positions of movement of component 30.
Figure 10:
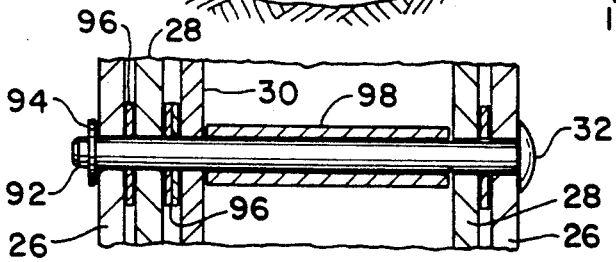
FIG. 10 is an isolated view of a pivot 32 allowing the movement positions of FIG. 9, in section taken along line 10—10 of FIG. 9.
Figure 11:
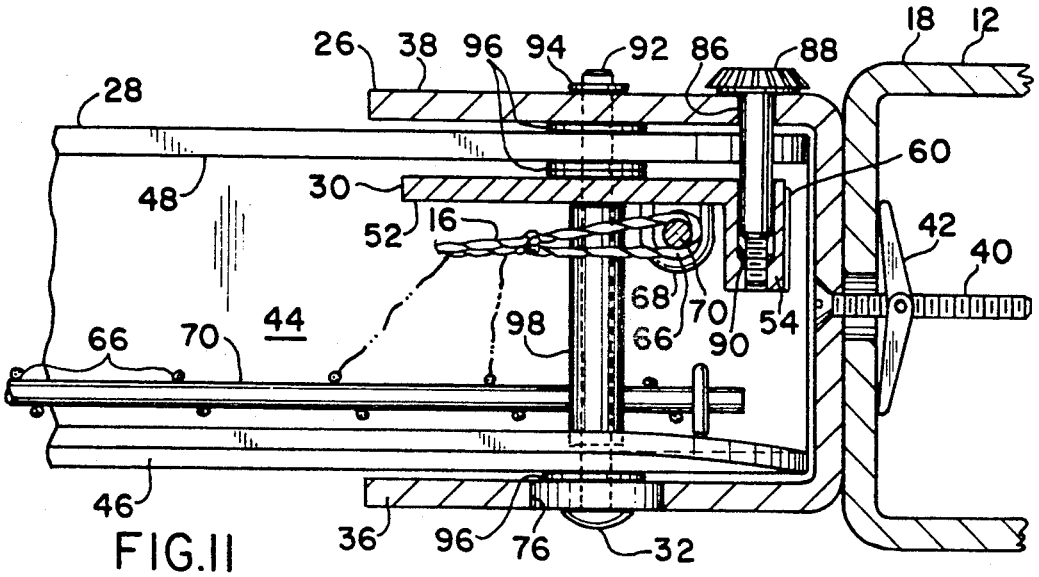
FIG. 11 is a similar view to FIG. 3, but of the game position of the soccer net as illustrated in phantom perspective in FIG. 1.

The degree of pivotal movement in the housings 28, 30 is about a pivot 32, as best shown in FIGS. 9 and 10, consisting of a pin 92 and projected through a spacer sleeve 98 and held in place by a C-ring 94. Washers 96 complete the spacing of the housings 26 and 28.

While the apparatus herein shown and disclosed in detail is fully capable of attaining the objects and providing the advantages hereinbefore stated, it is to be understood that it is merely illustrative of the presently preferred embodiment of the invention, and that no limitations are intended to the detail of construction herein shown other than as defined in the appended claims.

What is claimed is:

1. A storage compartment for a soccer net of a type having an operative position supported on right and left upstanding goal posts and a top cross piece connected in spanning relation therebetween, said storage compartment comprising a first U-shaped compartment member connected to extend rearwardly of said goal posts and cross piece such that side walls of said U-shape bound therebetween a first portion of said storage compartment, a net-support member pivotally mounted in said first portion of said storage compartment having in attached relation thereto a length portion of a peripheral edge of a soccer net, a second U-shaped compartment member bounding a second portion of said storage compartment pivotally connected to partake of opening and closing movement with respect to said first U-shaped compartment member having in attached relation thereto another length portion of said peripheral edge of said soccer net, said opening movement of said second U-shaped compartment member resulting in corresponding opening of said soccer net preparatory to the use thereof, and said closing movement of said second U-shaped compartment member against said first U-shaped compartment member defining a storage compartment of said first and second cooperating storage compartment portions, whereby when not in use said soccer net is in a storage condition in between said first and second U-shaped compartment members following the closing movement of said second U-shaped compartment member.

2. A storage compartment for a soccer net as claimed in claim 1 wherein said net-support member is pivotally moved into an operative position within said second U-shaped compartment member prior to the closing movement thereof against said first U-shaped compartment member, whereby said soccer net is advantageously located adjacent said second U-shaped compartment member to facilitate the manual placement thereof within said second portion of said storage compartment of said second U-shaped compartment member.

3. A storage compartment for a soccer net as claimed in claim 2 including key-operated lock means for the selective locking together of said first and second U-shaped compartment members in encircling relation about said soccer net, to thereby contribute to preventing damage to said soccer net when not in use.

* * * * *